US011183135B2

(12) United States Patent
Duan et al.

(10) Patent No.: US 11,183,135 B2
(45) Date of Patent: Nov. 23, 2021

(54) DRIVE CONTROL METHOD, ASSEMBLY AND DISPLAY DEVICE

(71) Applicants: BEIJING BOE DISPLAY TECHNOLOGY CO., LTD., Beijing (CN); BOE TECHNOLOGY GROUP CO., LTD., Beijing (CN)

(72) Inventors: Xin Duan, Beijing (CN); Xin Wang, Beijing (CN); Hao Zhu, Beijing (CN); Jieqiong Wang, Beijing (CN); Ming Chen, Beijing (CN); Xibin Shao, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/620,390

(22) PCT Filed: Jun. 4, 2018

(86) PCT No.: PCT/CN2018/089758
§ 371 (c)(1),
(2) Date: Dec. 6, 2019

(87) PCT Pub. No.: WO2018/223921
PCT Pub. Date: Dec. 13, 2018

(65) Prior Publication Data

US 2020/0090616 A1 Mar. 19, 2020

(30) Foreign Application Priority Data

Jun. 9, 2017 (CN) ..... 201710434373.3

(51) Int. Cl.
*G09G 3/36* (2006.01)
*G09G 5/00* (2006.01)

(52) U.S. Cl.
CPC ..... *G09G 3/3685* (2013.01); *G09G 5/006* (2013.01); *G09G 2310/0202* (2013.01);
(Continued)

(58) Field of Classification Search
CPC ..... G09G 2310/08; G09G 2310/0275; G09G 5/006; G09G 3/3685; G09G 3/2096;
(Continued)

(56) References Cited

U.S. PATENT DOCUMENTS 6,940,496 B1 9/2005 Kim
9,805,693 B2 * 10/2017 Amirkhany ..... G09G 5/18
(Continued)

FOREIGN PATENT DOCUMENTS

CN 1870115 A 11/2006
CN 101295476 A 10/2008
(Continued)

OTHER PUBLICATIONS

"Communication with Supplementary European Search Report", European Patent Application No. 18813801.0, dated Nov. 3, 2020, 21 pp.
(Continued)

*Primary Examiner* — Dismery Mercedes
(74) *Attorney, Agent, or Firm* — Myers Bigel, P.A.

(57) ABSTRACT

A drive control method, an assembly and a display device, belonging to the field of panel manufacturing, for signal drive control of a display panel. The drive control method is applied to a time sequence controller, the time sequence controller is connected through a first signal line to a plurality of source drivers which are connected in parallel. The drive control method includes generating a broadcast configuration instruction, the broadcast configuration instruction being used for instructing a plurality of source drivers to perform driver configuration according to the
(Continued)

broadcast configuration instruction, and sending the broadcast configuration instruction through the first signal line.

10 Claims, 7 Drawing Sheets

(52) U.S. Cl.
CPC ..... *G09G 2310/08* (2013.01); *G09G 2370/00* (2013.01); *G09G 2370/08* (2013.01); *G09G 2370/10* (2013.01)

(58) Field of Classification Search
CPC ..... G09G 2370/00; G09G 2370/10; G09G 2370/08; G06F 9/4411; G06F 9/3836
See application file for complete search history.

(56) References Cited

U.S. PATENT DOCUMENTS

| | | | | |
|---|---|---|---|---|
| 9,947,286 | B2 * | 4/2018 | Lin | G09G 3/3696 |
| 10,037,729 | B2 * | 7/2018 | Park | G09G 3/2096 |
| 10,089,918 | B2 * | 10/2018 | Kwon | G09G 3/2096 |
| 10,380,971 | B2 * | 8/2019 | Oh | G09G 5/008 |
| 10,559,640 | B2 * | 2/2020 | Ha | H01L 27/3262 |
| 2009/0284509 | A1 * | 11/2009 | Choe | G09G 3/2088 345/208 |
| 2010/0202579 | A1 * | 8/2010 | Ide | H04L 7/0337 375/376 |
| 2011/0037758 | A1 * | 2/2011 | Lim | H03L 7/0805 345/213 |
| 2011/0242066 | A1 | 10/2011 | Jeon et al. | |
| 2014/0078133 | A1 * | 3/2014 | Lee | G09G 3/2092 345/213 |
| 2016/0078829 | A1 * | 3/2016 | Yu | G09G 3/3685 345/87 |
| 2017/0053598 | A1 | 2/2017 | Kwon et al. | |
| 2017/0069257 | A1 * | 3/2017 | Lee | G09G 5/005 |
| 2017/0132966 | A1 * | 5/2017 | Lim | G09G 3/2092 |
| 2018/0006101 | A1 * | 1/2018 | Ha | H01L 27/32 |
| 2018/0122294 | A1 * | 5/2018 | Do | G09G 3/3225 |

FOREIGN PATENT DOCUMENTS

| | | | |
|---|---|---|---|
| CN | 102214429 | A | 10/2011 |
| CN | 102955679 | A | 3/2013 |
| CN | 104715706 | A | 6/2015 |
| CN | 106469537 | A | 3/2017 |

OTHER PUBLICATIONS

"Notice of First Review Opinion with English language translation", CN Application No. 201710434373.3, dated Jan. 5, 2021, 23 pp.

* cited by examiner

DRIVE CONTROL METHOD, ASSEMBLY AND DISPLAY DEVICE

RELATED APPLICATIONS

The present application is a 35 U.S.C. 371 national stage application of PCT International Application PCT/CN2018/089758, with an international filing date of Jun. 4, 2018, which claims the benefit of Chinese Patent Application No. 201710434373.3, filed on Jun. 9, 2017, the entire disclosures of which are incorporated herein by reference.

TECHNICAL FIELD

The present disclosure relates to the liquid crystal panel manufacturing field, and more particularly to a drive control method, an assembly and a display device.

BACKGROUND

A display device generally may comprise a display panel and a panel drive circuit for driving the display panel. The panel drive circuit may comprise a time sequence controller, a gate drive circuit and a source drive circuit. Generally speaking, a gate drive circuit comprises a plurality of gate drivers, and a source drive circuit comprises a plurality of source drivers.

The panel drive circuit generally comprises two signal lines, which herein may be respectively called a first signal line and a second signal line, and the first signal line has a signal transmission rate less than that of the second signal line. Under such circumstances, the first signal line may be called a low-speed signal line, which is typically used to identify a level state, whereas the second signal line may be called a high-speed signal line, which is typically used to transmit a high-speed differential signal.

To be specific, in the panel drive process, a point-to-point high-speed signal transmission technology is usually used for signal transmission, characterized in that a one-to-one second signal line is established between two devices (such as a time sequence controller and a source controller) of a panel drive circuit so as to transmit a high-speed differential signal. Usually by means of an embedded clock, the source driver restores the clock according to the received signal characteristics. Generally speaking, in addition to the second signal line, the time sequence controller is also provided with an additional first signal line. A plurality of source drivers are connected in parallel and connected to the first signal line. The first signal line is used to identify a level state so as to coordinate with the second signal line for clock synchronization between the time sequence controller and the source driver.

SUMMARY

Since the above-mentioned first signal line may only identify a level state, it has simple function and low utilization rate. To this end, the embodiments of the present disclosure provide a drive control method, an assembly and a display device.

In the first aspect, there is provided a drive control method applicable to a time sequence controller. The time sequence controller is connected with a plurality of source drivers that are parallel-connected, through a first signal line. The method may comprise: generating a broadcast configuration instruction for instructing the plurality of source drivers to perform driver configuration according to the broadcast configuration instruction; and transmitting the broadcast configuration instruction through the first signal line.

In an embodiment, each instruction transmitted in the first signal line comprises a preamble code, a start identifier, data bits and an end identifier that are sequentially arranged, wherein the preamble code is used to instruct a receiving terminal to perform clock and phase calibration, the start identifier is used to indicate the start of data transmission, the data bits are used to carry configuration data, and the end identifier is used to indicate the end of data transmission.

In an embodiment, the preamble code is obtained from consecutive binary 0s in at least 8 bits by Manchester encoding; the start identifier comprises consecutive binary 0s in at least 2 bits; the configuration data carried by the data bits is the data obtained by Manchester encoding; and the end identifier comprises consecutive binary 1s in at least 2 bits.

In an embodiment, the time sequence controller is connected with the plurality of source drivers respectively through a plurality of second signal lines, and the broadcast configuration instruction comprises the number, transmission rate and signal equalizer information of the second signal line connected with each source driver.

In an embodiment, after transmitting the broadcast configuration instruction through the first signal line, the method may further comprise: generating a point-to-point configuration instruction comprising an identification of a first source driver, the first source driver being any one of the plurality of source drivers; transmitting the point-to-point configuration instruction through the first signal line; receiving, through the first signal line, a configuration response instruction transmitted by the first source driver, the configuration response instruction being transmitted to the time sequence controller by the first source driver according to the point-to-point configuration instruction after the first source driver detects the identification in the point-to-point configuration instruction as the identification of the first source driver.

In an embodiment, before generating a point-to-point configuration instruction, the method may further comprise:

configuring an identification for the first source driver based on a target second signal line and the first signal line, the target second signal line being a second signal line connecting the time sequence controller and the first source driver.

In a second aspect, there is provided a drive control method applicable to a first source driver. The first source driver is any one of the plurality of source drivers. The plurality of source drivers are connected in parallel and connected with a time sequence controller through a first signal line. The method may comprise: receiving a broadcast configuration instruction transmitted by the time sequence controller through the first signal line; and performing driver configuration according to the broadcast configuration instruction.

In an embodiment, each instruction transmitted in the first signal line comprises a preamble code, a start identifier, data bits and an end identifier that are sequentially arranged, wherein the preamble code is used to instruct a receiving terminal to perform clock and phase calibration, the start identifier is used to indicate the start of data transmission, the data bits are used to carry configuration data, and the end identifier is used to indicate the end of data transmission.

In an embodiment, the preamble code is obtained from consecutive binary 0s in at least 8 bits by Manchester encoding; the start identifier comprises consecutive binary 0s in at least 2 bits; the configuration data carried by the data bits is the data obtained by Manchester encoding; and the end identifier comprises consecutive binary 1s in at least 2 bits.

In an embodiment, the time sequence controller is connected with the plurality of source drivers respectively through a plurality of second signal lines, and the broadcast configuration instruction comprises the number, transmission rate and signal equalizer information of the second signal line connected with each source driver.

In an embodiment, after performing driver configuration according to the broadcast configuration instruction, the method may further comprise: receiving a point-to-point configuration instruction transmitted by the time sequence controller through the first signal line, the point-to-point configuration instruction comprising an identification; detecting whether the identification in the point-to-point configuration instruction is the identification of the first source driver; and transmitting a configuration response instruction to the time sequence controller through the first signal line according to the point-to-point configuration instruction after the identification in the point-to-point configuration instruction is determined as the identification of the first source driver.

In an embodiment, before receiving a point-to-point configuration instruction transmitted by the time sequence controller through the first signal line, the method may further comprise: based on a target second signal line and the first signal line, acquiring the identification that is configured for the first source driver by the time sequence controller, the target second signal line being a second signal line connecting the time sequence controller and the first source driver.

In a third aspect, there is provided a drive control assembly applicable to a time sequence controller. The time sequence controller is connected with a plurality of source drivers that are parallel-connected, through a first signal line. The assembly may comprise: a generator used to generate a broadcast configuration instruction for instructing the plurality of source drivers to perform driver configuration according to the broadcast configuration instruction; and a transmitter used to transmit the broadcast configuration instruction through the first signal line.

In an embodiment, each instruction transmitted in the first signal line comprises a preamble code, a start identifier, data bits and an end identifier that are sequentially arranged, wherein the preamble code is used to instruct a receiving terminal to perform clock and phase calibration, the start identifier is used to indicate the start of data transmission, the data bits are used to carry configuration data, and the end identifier is used to indicate the end of data transmission.

In an embodiment, the preamble code is obtained from consecutive binary 0s in at least 8 bits by Manchester encoding; the start identifier comprises consecutive binary 0s in at least 2 bits; the configuration data carried by the data bits is the data obtained by Manchester encoding; and the end identifier comprises consecutive binary 1s in at least 2 bits.

In an embodiment, the time sequence controller is connected with the plurality of source drivers respectively through a plurality of second signal lines, and the broadcast configuration instruction comprises the number, transmission rate and signal equalizer information of the second signal line connected with each source driver.

In an embodiment, the generator is also used to generate a point-to-point configuration instruction comprising an identification of a first source driver, the first source driver being any one of the plurality of source drivers; and the transmitter is also used to transmit the point-to-point configuration instruction through the first signal line.

The assembly may further comprise: a receiver used to receive, through the first signal line, a configuration response instruction transmitted by the first source driver, the configuration response instruction being transmitted to the time sequence controller by the first source driver according to the point-to-point configuration instruction after the first source driver detects the identification in the point-to-point configuration instruction as the identification of the first source driver.

In an embodiment, the assembly may further comprise: a configurer used to configure an identification for a first source driver based on a target second signal line and the first signal line, the target second signal line being a second signal line connecting the time sequence controller and the first source driver.

In the fourth aspect, there is provided a drive control assembly applicable to a first source driver. The first source driver is any one of the plurality of source drivers. The plurality of source drivers are connected in parallel, and are connected with a time sequence controller through a first signal line. The assembly may comprise: a receiver used to receive a broadcast configuration instruction transmitted by the time sequence controller through the first signal line; and a configurer used to perform driver configuration according to the broadcast configuration instruction.

In an embodiment, each instruction transmitted in the first signal line comprises a preamble code, a start identifier, data bits and an end identifier that are sequentially arranged, wherein the preamble code is used to instruct a receiving terminal to perform clock and phase calibration, the start identifier is used to indicate the start of data transmission, the data bits are used to carry configuration data, and the end identifier is used to indicate the end of data transmission.

In an embodiment, the preamble code is obtained from consecutive binary 0s in at least 8 bits by Manchester encoding; the start identifier comprises consecutive binary 0s in at least 2 bits; the configuration data carried by the data bits is the data obtained by Manchester encoding; and the end identifier comprises consecutive binary 1s in at least 2 bits.

In an embodiment, the time sequence controller is connected with the plurality of source drivers respectively through a plurality of second signal lines, and the broadcast configuration instruction comprises the number, transmission rate and signal equalizer information of the second signal line connected with each source driver.

In an embodiment, the receiver is also used to receive a point-to-point configuration instruction transmitted by the time sequence controller through the first signal line, the point-to-point configuration instruction comprising identification.

The assembly may further comprise a detector used to detect whether the identification in the point-to-point configuration instruction is the identification of the first source driver; and a transmitter used to transmit a configuration response instruction to the time sequence controller through the first signal line according to the point-to-point configuration instruction after the identification in the point-to-point configuration instruction is determined as the identification of the first source driver.

In an embodiment, the assembly may further comprise: an acquirer used to, based on a target second signal line and the first signal line, acquire the identification that is configured for the first source driver by the time sequence controller, the target second signal line being a second signal line connecting the time sequence controller and the first source driver.

In a fifth aspect, there is provided a display device comprising a time sequence controller and a source driver, wherein the time sequence controller comprises the drive control assembly according to the third aspect, and the source driver comprises the drive control assembly according to the fourth aspect.

BRIEF DESCRIPTION OF DRAWINGS

To explain the embodiments of the present disclosure more clearly, the drawings used for describing the embodiments will be introduced briefly hereinafter. The drawings described below are only directed to some embodiments of the present disclosure. Those having ordinary skills in the art may also obtain other drawings from these drawings without making creative work.

The drawings herein are incorporated into the description and constitute a part of the description. They illustrate the embodiments that comply with the present disclosure, and are used, together with the description, to explain the principle of the present disclosure.

DETAILED DESCRIPTION

To understand the objects, technical solutions and advantages of the present application more clearly, the present application will be described in detail with reference to the drawings. Apparently, the embodiments described herein are only a part of, not the whole, of the embodiments of the present disclosure. All other embodiments obtained by those having ordinary skill in the art based on the embodiments of the present disclosure without making creative work fall within the protection scope of the present disclosure.

The drive control method, assembly and device provided by the embodiments of the present disclosure can transmit a broadcast configuration instruction through a first signal line so as to realize the control of various source drivers by a time sequence controller, thereby enriching the functions of the first signal line and enhancing the utilization rate of the first signal line.

It shall be understood that the above general description and the subsequent detailed description are merely exemplary and cannot impose a limitation on the present disclosure.

Figure 1A:
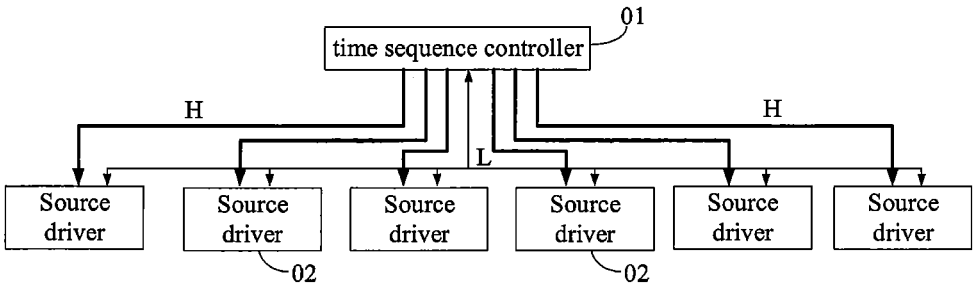
FIG. 1A is a schematic view showing the application environment of a drive control method provided by an embodiment of the present disclosure.

With reference to FIG. 1A, FIG. 1A is a schematic view showing the application environment of a drive control method provided by an embodiment of the present disclosure. As shown in FIG. 1A, the application environment may be a display device comprising a time sequence controller 01 and a plurality of source drivers 02. The time sequence controller 01 is connected with a plurality of source drivers 02 respectively through a plurality of second signal lines H. Typically, the plurality of second signal lines H of the time sequence controller 01 are connected with the plurality of source drivers 02 in a one-to-one relationship. The signal in the second signal line is transmitted unidirectionally. The time sequence controller is also connected with a first signal line L. The plurality of source drivers 02 are connected in parallel and connected with the first signal line L. The signal in the first signal line is transmitted bidirectionally.

In a panel drive circuit of a conventional display device, the first signal line L as mentioned above can only be used to identify a level state. For instance, the first signal line L is used to set the pin of a source driver to be at a high or low level.

However, in the embodiment of the present disclosure, in addition to identifying a level state, the first signal line L may also transmit other instructions to realize different data transmission functions. Each data transmission function corresponds to at least one transmission mode. For instance, a time sequence controller can realize the function of transmitting a broadcast configuration instruction to a source driver through the first signal line, and the function corresponds to a broadcast mode. In the broadcast mode, the time sequence controller broadcasts data. Another example is that the time sequence controller may transmit an identity configuration instruction to a source driver through the first signal line so as to realize the function of transmitting an identification (ID) to the source driver, and the function may correspond to an ID assignment (IA) mode. In the IA mode, the time sequence controller will assign an ID to the source driver. Another example is that the time sequence controller may transmit a point-to-point configuration instruction to the source driver through the first signal line so as to realize the function of point-to-point control of the source driver, and the function may correspond to a downstream communication (DC) mode. In the DC mode, the time sequence controller will perform point-to-point data transmission with the source driver. Another example is that the source driver may transmit a control response instruction directed to the point-to-point configuration instruction to the time sequence controller through the first signal line or an identity configuration response instruction directed to the identity configuration instruction to the time sequence controller through the first signal line, and the function may correspond to a reply transaction (RT) mode. In the RT mode, the source driver will reply to the instructions of the time sequence controller. Through the cooperation of the above modes (or functions), the time sequence controller may sequentially complete the IA of the source driver, the read/write operation of the data, and the reception of data feedback from the source driver, etc.

In the embodiment of the present disclosure, the instructions transmitted between the time sequence controller and the source driver may be in the same format. For instance, each instruction transmitted in the first signal line may comprise a preamble code, a start identifier, data bits (also known as a transaction body) and an end identifier that are sequentially arranged.

In an embodiment, the preamble code is used to instruct a receiving terminal to perform clock and phase calibration. When the receiving terminal (such as the time sequence controller or source driver) detects the transmission of the preamble code on the first signal line, it will perform clock and phase adjustment according to the contents of the preamble code. According to the present disclosure, the clock and phase adjustment refers to keeping the clock consistent with the clock at a transmitting terminal and to keeping the phase identical with that at the transmitting terminal. The receiving terminal adjusts the clock and phase in the process of receiving the preamble code. After the preamble code transmission, the clock and phase adjustment is completed. The start identifier is used to indicate the start of data transmission, the data bits are used to carry configuration data, and the end identifier is used to indicate the end of data transmission.

Figure 1B:
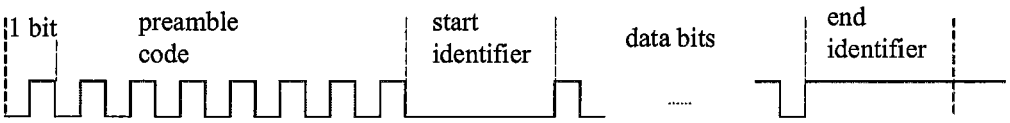
FIG. 1B is a schematic view showing the format of a signal transmitted in a first signal line provided by an embodiment of the present disclosure.

According to the present disclosure, the preamble code may be obtained from consecutive binary 0s (or 1s) in at least 8 bits by Manchester encoding; the start identifier may maintain a low-level signal (or a high-level signal) and not be Manchester encoded (e.g., it comprises consecutive binary 0s or 1s in at least 2 bits); the configuration data carried by the data bits is the data obtained by Manchester encoding; and the end identifier may maintain a high-level signal and not be Manchester encoded (e.g., it comprises consecutive binary 1s in at least 2 bits). FIG. 1B illustrates an example of the format of an instruction transmitted between the time sequence controller and the source driver through the first signal line. As shown in FIG. 1B, the preamble code is obtained from consecutive binary 0s in 8 bits by Manchester encoding; the start identifier is consecutive binary 0s in 2 bits; the configuration data carried by the data bits is indicated by an ellipsis; and the end identifier is consecutive binary 1s in 2 bits.

It should be explained that since Manchester encoding can produce an obvious jump edge in data for easy data detection, so Manchester encoding may be used for data that need to be encoded in the embodiments of the present disclosure. But in practical applications, the data may be encoded by other encoding methods or not encoded at all. Furthermore, in order to ensure that the configuration data carried by data bits can be effectively identified at a decoding terminal, reference may be made to FIG. 1B, in which the first bit of the configuration data in the data bits can produce a jump edge relative to the start identifier (that is, the first bit of the configuration data in the data bits has a different value from the last bit of the start identifier, for example, the first bit of the configuration data in the data bits is 1, and the last bit of the start identifier is 0), and the last bit of the configuration data in the data bits can produce a jump edge relative to the end identifier (that is, the last bit of the configuration data in the data bits has a different value from the first bit of the end identifier, for example, the last bit of the configuration data in the data bits is 0, and the first bit of the end identifier is 1). The jump edges mentioned above may facilitate the effective identification of data at the receiving end.

In the above different instructions, the configuration data carried by the data bits may comprise: a signal for indicating the transmission mode of the first signal line. As stated above, the transmission mode may be the foregoing broadcast mode, IA mode, DC mode, or RT mode. The signal for indicating the transmission mode of the first signal line may occupy, e.g., 2 bits in the data bits. The current data transmission mode can be determined by detecting the signal.

In the embodiment of the present disclosure, the instruction transmitted in the first signal line may comprise: a broadcast configuration instruction, a point-to-point transmission instruction, an identity configuration instruction, an identity configuration response instruction or a configuration response instruction. The broadcast configuration instruction, the point-to-point transmission instruction, and the identity configuration instruction are transmitted to the source driver from the time sequence controller. In an embodiment, the transmission mode of the broadcast configuration instruction is the broadcast mode, the transmission mode of the point-to-point transmission instruction is the DC mode, and the transmission mode of the identity configuration instruction is the ID mode. The identity configuration response instruction and the configuration response instruction are transmitted to the time sequence controller from the source driver. The identity configuration response instruction is the response instruction directed to the identity configuration instruction, and the configuration response instruction is the response instruction directed to the point-to-point transmission instruction. The transmission mode of both the identity configuration response instruction and the configuration response instruction is the RT mode.

In an embodiment, the configuration data in the data bits of the broadcast configuration instruction may comprise the number (e.g., the total number of high-speed channels H connected with the time sequence controller), transmission rate (e.g., the transmission rate of data in various second signal lines) and signal equalizer (EQ) information of the second signal line.

In an embodiment, suppose the receiving terminal of the point-to-point configuration instruction is a first source driver, the configuration data carried by the data bits of the point-to-point configuration instruction may comprise, e.g., an ID of the source driver, the address and operational type of a register needed to be configured in the source driver, and data corresponding to the operation indicated by the operational type.

Figure 2:
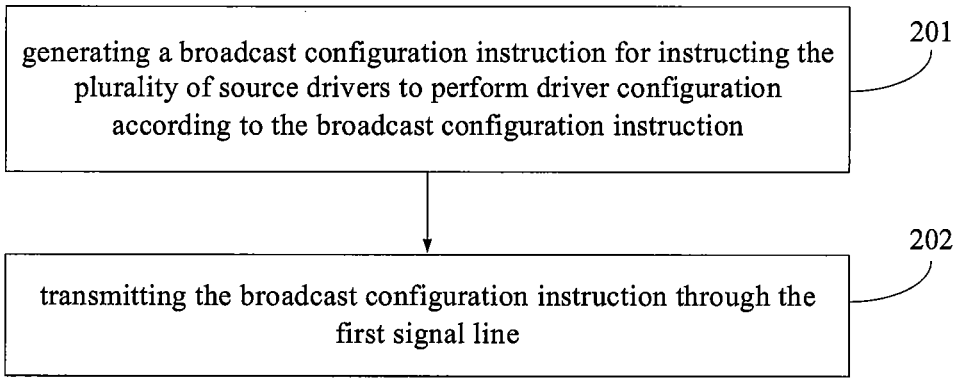
FIG. 2 is a flowchart schematic view of a drive control method provided by an embodiment of the present disclosure.

With reference to FIG. 2, FIG. 2 is the flowchart schematic view of a drive control method provided by an embodiment of the present disclosure. The drive control method may be applied to the time sequence controller in FIG. 1A. The time sequence controller is connected with a plurality of source drivers that are parallel-connected, through a first signal line. As shown in FIG. 2, the drive control method may comprise:

in Step 201: generating a broadcast configuration instruction for instructing the plurality of source drivers to perform driver configuration according to the broadcast configuration instruction; and in Step 202: transmitting the broadcast configuration instruction through the first signal line.

The drive control method provided by the embodiment of the present disclosure can transmit a broadcast configuration instruction through a first signal line so as to realize the control of various source drivers by the time sequence controller, thereby enriching the functions of the first signal line and enhancing the utilization rate of the first signal line.

Figure 3:
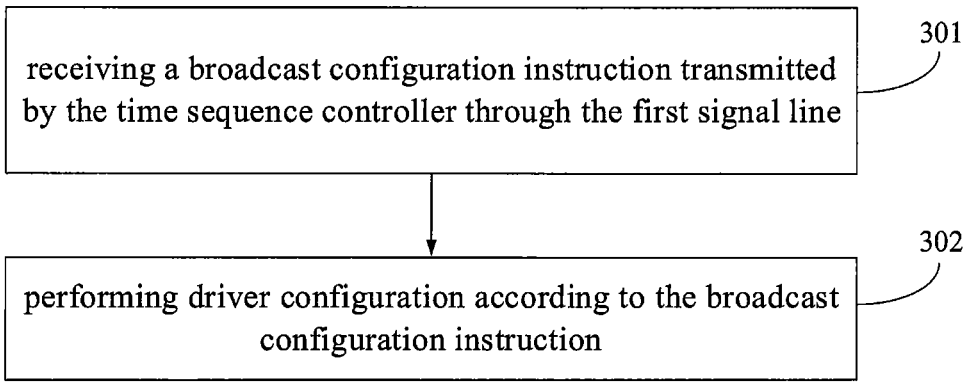
FIG. 3 is a flowchart schematic view of a drive control method provided by an embodiment of the present disclosure.

With reference to FIG. 3, FIG. 3 is a flowchart schematic view of a drive control method provided by an embodiment of the present disclosure. The drive control method may be applied to a source driver in FIG. 1A (e.g., a first source driver). The source driver is any one of the plurality of source drivers. The plurality of source drivers are connected in parallel and connected with the time sequence controller through the first signal line. As shown in FIG. 3, the drive control method may comprise:

in Step 301: receiving a broadcast configuration instruction transmitted by the time sequence controller through the first signal line; and in Step 302: performing driver configuration according to the broadcast configuration instruction.

The drive control method provided by the embodiment of the present disclosure can receive a broadcast configuration instruction transmitted by the time sequence controller through a first signal line so as to realize the control the first source driver by the time sequence controller, thereby enriching the functions of the first signal line and enhancing the utilization rate of the first signal line.

It shall be explained that in a typical panel drive circuit, it is usually by means of an embedded clock that the source driver restores the clock according to signal characteristics received by the second signal line, and the first signal line is only used to identify a level state.

Due to this feature, it is usually required to make corresponding preparations by a second signal line prior to the transmission of display data. For instance, clock calibration is performed to ensure that the work clock of the time sequence controller is synchronized with that of the source driver. For a configuration instruction, a portion of which is transmitted in a second signal line, it needs to be transmitted after the completion of the preparation (e.g., clock synchronization). Some functions that need to be set after power-on initialization (prior to the clock synchronization through the second signal line) are usually set only by means of making the pin level of the source driver high (or low), which may limit the flexibility of debugging or setting thereof. Even when the pin level needs to be modified, the driver design may be modified. These cause unnecessary consumption.

Figure 4A:
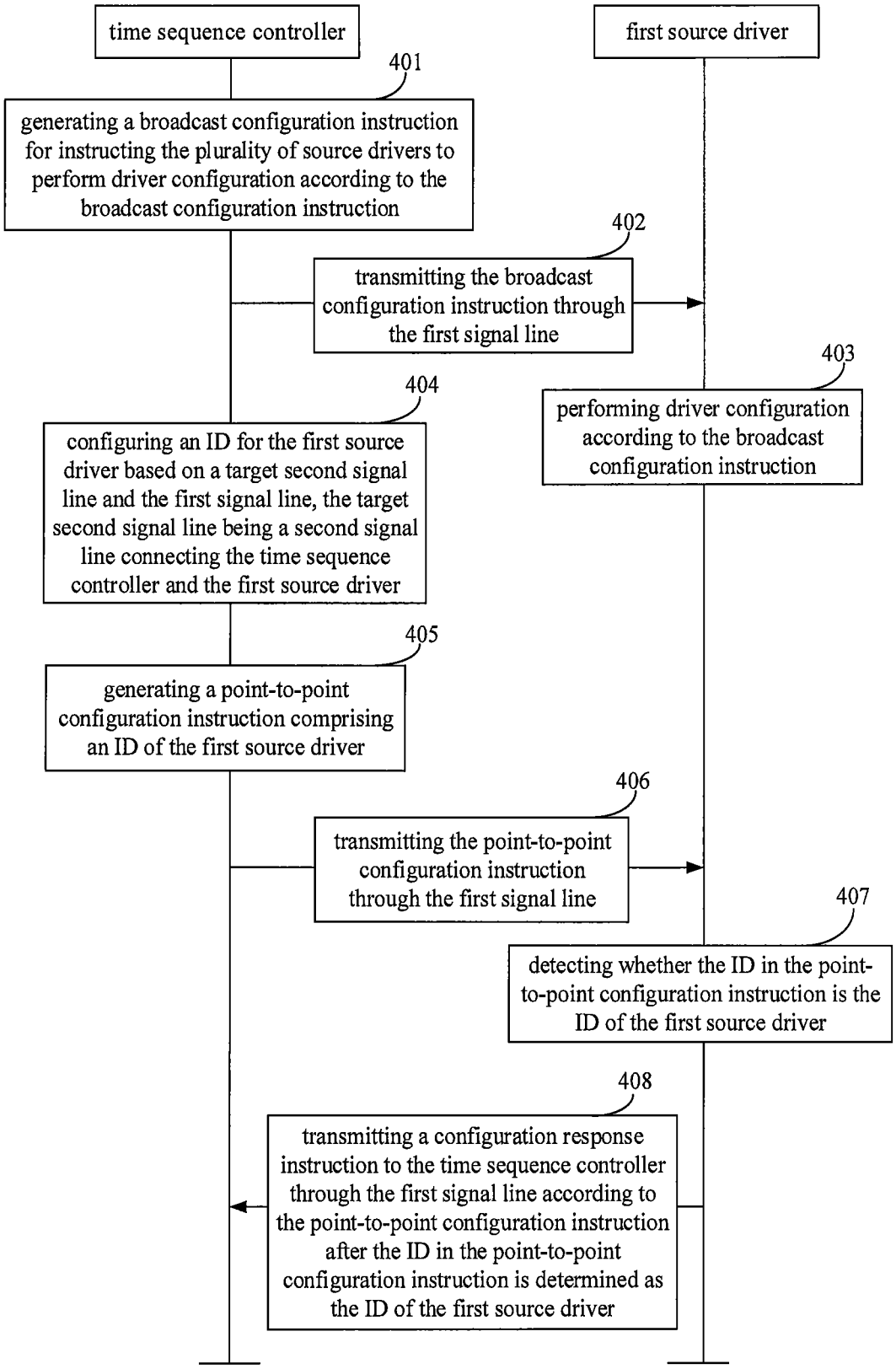
FIG. 4A is a flowchart schematic view of a drive control method provided by an embodiment of the present disclosure.

However, in the embodiments of the present disclosure, prior to the clock synchronization through the second signal line, data transmission, especially some functions that need to be set after the power-on initialization, can be realized by the broadcast configuration instruction and/or the point-to-point configuration instruction through the first signal line. This requires no modification of the driver design and reduces unnecessary consumption. To be specific, with reference to FIG. 4A, FIG. 4A is a flowchart schematic view of a drive control method provided by an embodiment of the present disclosure. The drive control method may be applied to the application environment in FIG. 1A. Suppose the first source driver is any one of the plurality of source drivers, the drive control method may comprise:

in Step 401: the time sequence controller generating a broadcast configuration instruction for instructing the plurality of source drivers to perform driver configuration according to the broadcast configuration instruction.

In the embodiment of the present disclosure, the broadcast configuration instruction may carry data required to be configured for each source driver prior to the clock synchronization through the second signal line, so that the source drivers can perform unified data configuration after power-on. For instance, the broadcast configuration instruction may comprise the number, transmission rate and signal equalizer information of the second signal line.

In Step 402: the time sequence controller transmits the broadcast configuration instruction through the first signal line.

In Step 403: the first source driver performs driver configuration according to the broadcast configuration instruction.

After receiving the broadcast configuration instruction transmitted by the time sequence controller through the first signal line, the first source driver may perform driver configuration according to the broadcast configuration instruction, and the driver configuration process is the basic initialization setting performed when high-speed channels establish connections. In an embodiment, the broadcast configuration instruction may comprise the number of the second signal lines connected with each source driver. In this case, the source driver may store the number of the second signal lines connected therewith. Furthermore, during the clock calibration phase, the source driver needs to determine the number of the second signal lines to be calibrated according to the number of the second signal lines connected therewith that is stored in the source driver. For instance, it determines whether one second signal line or two second signal lines are required to meet the calibration requirement. It should be explained that when the second signal line is a differential signal line, one second signal line is actually a differential signal line made of two sub-signal lines. In an embodiment, the broadcast configuration instruction may comprise a transmission rate of the second signal line or first signal line. The transmission rate may be used to inform the source driver of the transmission rate for the signal transmission to be carried out. Thus, when the clock is calibrated, the source driver can accurately work under an agreed transmission rate. In an embodiment, the broadcast configuration instruction may comprise signal equalizer information. The signal equalizer information may be used to indicate a signal gain level. Different signal equalizer information may indicate different signal gain levels. The source driver may strengthen the received signal according to the signal equalizer information included in the broadcast configuration instruction. Thus, when an attenuated signal cannot be received correctly, the signal may be raised to the range in which the signal can be normally received by the source driver according to the level-strengthened signal indicated by the signal equalizer information. In addition, the source drivers at different locations may achieve states with similar signal amplitudes through different gain settings. In this way, the source drivers can adjust their signals respectively according to the signal equalizer information thereof so as to obtain the data signals that can be normally received.

It should be explained that under normal conditions, one source driver is connected with one second signal line. But under some special occasions, one second signal line may not meet the transmission requirement of the source driver, so one source driver may also be connected with at least two second signal lines accordingly. In practical application, the broadcast configuration instruction may comprise the number of the second signal lines connected with each source driver. The number of the second signal lines connected with each source driver may be the same or different. When the number of the second signal lines connected with each source driver is the same, the broadcast configuration instruction may only carry the number of one second signal line (e.g., the carried number is 1) to indicate that each source driver is connected with one second signal line. Thus, each source driver is configured according to that number.

Furthermore, the drive control method may comprise Step 404. In Step 404, the time sequence controller configures an ID for the first source driver based on a target second signal line and the first signal line, and the target second signal line is a second signal line connecting the time sequence controller and the first source driver. According to the present disclosure, the step may be carried out repeatedly so that the time sequence controller configures IDs for all the source drivers in a panel drive circuit.

It should be explained that the ID of the source driver is pre-configured by the time sequence controller for the source driver, which may ensure that the time sequence controller identifies the source driver effectively. In an embodiment of the present disclosure, the time sequence controller may generally pre-configure the ID of the source driver (e.g., the first source driver) in a software manner.

Figure 4B:
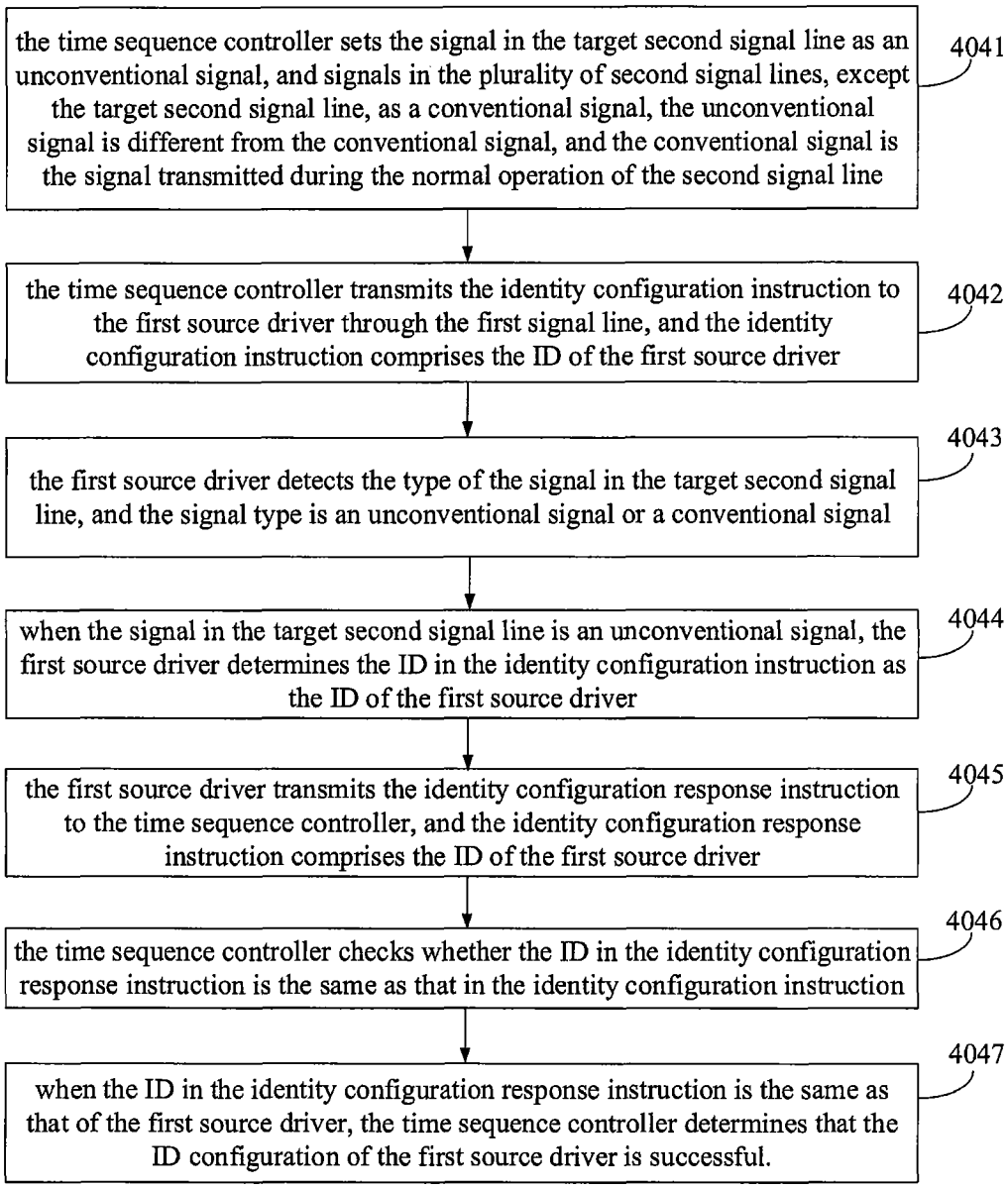
FIG. 4B is a flowchart schematic view of an identification configuration provided by an embodiment of the present disclosure.

In an embodiment, the source driver may be configured with an ID to based on the target second signal line and the first signal line connected with the source driver so as to realize software configuration. The software configuration process is simple and convenient, which can enhance the flexibility of signal transmission between the time sequence controller and the source driver and reduce the complexity of configuration. FIG. 4B illustrates, by way of example, the process of configuring an ID for the first source driver based on the target second signal line and the first signal line. The process may comprise Step 4041 at the beginning.

In the Step 4041, the time sequence controller sets the signal in the target second signal line connected with the first source driver as an unconventional signal, and signals in the plurality of second signal lines, except the target second signal line, as a conventional signal. In an embodiment, the unconventional signal is different from the conventional signal, and the conventional signal is the signal transmitted during the normal operation of the second signal line. Those skilled in the art may also use other signals that can be distinguished from each other.

Since the source driver needs to configure an ID for each of the source drivers, the process of ID configuration is actually a time-sharing configuration process. That is to say, different source drivers are configured with IDs at different time periods. During the process of configuring ID for a specific source driver, in order to ensure that the source driver knows this is the time period in which the time sequence controller configures an ID for it, the time sequence controller needs to provide corresponding prompt information for the source driver. In an embodiment of the present disclosure, the prompt information can be realized by the second signal line. Suppose the signal transmitted during the normal operation of the high-speed signal is a conventional signal. In this case, the specific source driver can be prompted by setting the signal in the target second signal line connected with the specific source driver as an unconventional signal different from the conventional signal, and setting the signals in the plurality of second signal lines, except the target second signal line, as a conventional signal. Thus, since the specific source driver knows both the conventional signal and the unconventional signal, it can judge that it is being configured with an ID by the time sequence controller according to the fact that the received signal is an unconventional signal. Meanwhile, other source drivers can also judge that they are not currently configured with IDs by the time sequence controller according to the fact that the received signal is a conventional signal. In another embodiment, the specific source driver can be prompted by setting the signal in the target second signal line connected with the specific source driver as a conventional signal, and setting the signals in the plurality of second signal lines, except the target second signal line, as an unconventional signal different from the conventional signal.

The second signal line is usually a differential signal line, and transmits data by way of differential transmission. Differential transmission is a signal transmission technology, which is different from the conventional signal transmission technology that uses one signal line and one ground line. In differential transmission, signals are transmitted in both lines with the same signal amplitude and opposite phases. The signals transmitted in the two lines are differential signals. In an embodiment of the present disclosure, the differential signal line for realizing the differential transmission comprises two sub-signal lines. In normal operation, the two sub-signal lines have different levels. That is to say, one signal line is at a high level, and the other signal line is at a low level. In this case, the process of setting the signal in the target second signal line as an unconventional signal, and setting the signals in the plurality of second signal lines, except the target second signal line, as a conventional signal may comprise: setting the signals in the two sub-signal lines of the target second signal line at the same level (e.g., setting the two sub-signal lines at a low level or a high level). The signals in the two sub-signal lines included in each second signal line of the plurality of second signal lines, except the target second signal line, are set at the different levels.

In Step 4042, the time sequence controller transmits the identity configuration instruction to the first source driver through the first signal line, and the identity configuration instruction comprises the ID of the first source driver.

In Step 4043, the first source driver detects the type of the signal in the target second signal line. The signal type is an unconventional signal or a conventional signal.

After the first source driver receives the identity configuration instruction transmitted by the time sequence controller through the first signal line, the first source driver detects the type of the signal in the target second signal line connected with the first source driver. In an embodiment, suppose the second signal line is the differential signal line as stated above. In this case, the first source driver detecting the type of the signal in the target second signal line may comprise: detecting the signals in the two sub-signal lines of the target second signal line. When the signals in the two sub-signal lines are at the same level, the first source driver determines the signal in the target second signal line as an unconventional signal. When the signals in the two sub-signal lines are at the different levels, the first source driver determines the signal in the target second signal line as a conventional signal.

In Step 4044, when the signal in the target second signal line is an unconventional signal, the first source driver determines the ID in the identity configuration instruction as its own ID.

Since a plurality of source drivers are connected in parallel, and are connected to one first signal line in series, all source drivers may receive the identity configuration instruction every time the time sequence controller transmits the identity configuration instruction. When the source driver determines that the signal in the corresponding target second signal line is an unconventional signal, it can be determined that the ID carried in the identity configuration instruction is configured for itself, and then the ID is stored. When the source driver determines that the signal in the corresponding target second signal line is a conventional signal, it can be determined that the ID carried in the identity configuration instruction is not configured for itself, and the identity configuration instruction may be ignored.

As known from the above, the second signal line plays a prompt function in the software configuration process, and the first signal line plays an instruction transmission function in the software configuration process.

In Step 4045, the first source driver transmits the identity configuration response instruction to the time sequence controller. The identity configuration response instruction may comprise the ID of the first source driver.

In an embodiment of the present disclosure, after identifying the ID in the identity configuration instruction as its own identity, the specific source driver may transmit the identity configuration response instruction carrying the ID to the time sequence controller so as to prompt the time sequence controller that it completes the ID configuration.

In Step 4046, the time sequence controller checks whether the ID in the identity configuration response instruction is the same as that in the identity configuration instruction previously transmitted by itself.

After receiving the identity configuration response instruction transmitted by the first source driver, the time sequence controller may check whether the ID in the identity configuration response instruction is the same as that in the identity configuration instruction previously transmitted by itself.

In Step 4047, when the ID in the identity configuration response instruction transmitted by the first source driver is the same as that in the identity configuration instruction previously transmitted by the time sequence controller, the time sequence controller determines that the ID configuration of the first source driver is successful.

It should be explained that when the ID in the identity configuration response instruction transmitted by the first source driver is different from that in the identity configuration instruction previously transmitted by the time sequence controller, the time sequence controller may determine the instruction transmission between itself and the first source driver is abnormal. In this case, the time sequence controller and the first source driver may re-execute the above steps 4041 to 4047 until the time sequence controller determines that the ID in the identity configuration response instruction is the same as that in the identity configuration instruction previously transmitted by itself.

In an embodiment of the present disclosure, after the Step 4042, if the time sequence controller does not receive the identity configuration response instruction transmitted by the first source driver within the preset time period (the preset time period may be equal to the preset feedback timeout threshold), the time sequence controller may determine that the first source driver replies overtime and the instruction transmission therebetween is abnormal. In such a case, the time sequence controller and the first source driver may re-execute the above Steps 4041-4047 until the time sequence controller receives, within the preset time period after transmitting the identity configuration instruction, the identity configuration response instruction transmitted by the first source driver.

In an embodiment of the present disclosure, when the second signal line is a differential signal line, the signals in the two sub-signal lines of the differential signal line connected with the first source driver may be lowered (or raised). Thus, as stated above, the first source driver can identify that the time sequence controller performs assignment operation (i.e., the operation of ID configuration) on itself by the change on the differential signal line. After the first source driver receives the identity configuration instruction transmitted by the time sequence controller, it uses the ID carried therein as its own ID, and returns the ID to the time sequence controller. The time sequence controller determines whether the assignment succeeds or not according to the returned ID. This process can realize the assignment of the source driver quickly and effectively.

The first signal line according to the present disclosure is a special is signal line. It may transmit an instruction to the corresponding source driver and receives the response instruction transmitted by the source driver, thereby achieving the bidirectional signal transmission.

Then, let's return to the drive control method shown in FIG. 4A.

In Step 405, the time sequence controller generates a point-to-point configuration instruction comprising the ID of the first source driver and/or configuration data directed to the first source driver.

According to the present disclosure, the time sequence controller may perform a point-to-point control of a specific source driver by the point-to-point instruction. In the embodiment of the present disclosure, the point-to-point configuration instruction may carry data that need to be configured for the specific source driver before the clock synchronization of the second signal line, thereby achieving a separate configuration for the specific source driver. For instance, when it is only necessary to perform a read or write operation for the first source driver, the time sequence controller may transmit the point-to-point configuration instruction directed to the first source driver. The data bits of the point-to-point configuration instruction may comprise a pre-configured ID of the first source driver, the address and operational type of a register needed to be configured in the first source driver, and data corresponding to the operation indicated by the operational type. The operational type may be a read type or a write type or others.

In Step 406, the time sequence controller transmits the point-to-point configuration instruction through the first signal line.

In Step 407, the first source driver detects whether the ID in the point-to-point configuration instruction is the ID of the first source driver.

After receiving the point-to-point configuration instruction transmitted by the time sequence controller through the first signal line, each source driver will detect whether the ID included in the point-to-point configuration instruction matches with its own ID. When the ID included in the point-to-point configuration instruction does not match with its own ID, the source driver determines that the point-to-point configuration instruction is not directed to itself, and further does not process the point-to-point configuration instruction. When the ID included in the point-to-point configuration instruction matches with its own ID, the source driver determines the point-to-point configuration instruction is directed to itself, and further configures itself according to the operation indicated by the point-to-point configuration instruction. In an embodiment of the present disclosure, the first source driver detects that the ID in the point-to-point configuration instruction is its own ID, so it determines that the point-to-point configuration instruction is directed to itself. Other source driver detects that the ID in the point-to-point configuration instruction is not its own ID, so it determines that the point-to-point configuration instruction is not directed to itself. Those skilled in the art shall realize that the ID match does not mean the two IDs must be completely the same. In an embodiment, the ID included in the point-to-point configuration instruction may be an abbreviation of the ID stored in the source driver, thereby saving transmission resources.

In Step 408, after determining the ID in the point-to-point configuration instruction as its own ID, the first source driver transmits a configuration response instruction to the time sequence controller through the first signal line according to the point-to-point configuration instruction.

After determining the ID in the point-to-point configuration instruction as its own ID, the first source driver may perform the operation indicated by the point-to-point configuration instruction, such as a read operation or a write operation or a driver setting operation. After performing the corresponding operation, the first source driver generates a configuration response instruction for indicating the completion of instruction execution and transmits it to the time sequence controller.

In an embodiment, when the configuration response instruction needs to be transmitted to the time sequence controller, the first source driver may transmit the configuration response instruction to the time sequence controller only after a preset reply wait time since the reception of the point-to-point configuration instruction.

The reply wait time may be longer than a standby time and less than a feedback timeout threshold. In an embodiment, the standby time may be 10 microseconds (μs), the feedback timeout threshold may be 300 microseconds, and the reply wait time is longer than 10 microseconds and less than 300 microseconds.

The standby time, also referred as the instruction waiting time, is the time interval between two adjacent instructions transmitted by the time sequence controller. The reply wait time of the first source driver is longer than the standby time, which may prevent the first source driver from transmitting an instruction when the time sequence controller has not finished transmitting an instruction, thereby avoiding line collision. The feedback timeout threshold is preset. When the interval between the reception of the point-to-point configuration instruction by the first source driver and the transmission of the configuration response instruction by the first source driver is longer than the feedback timeout threshold, it may be deemed that the configuration response instruction has expired and is not effective any longer, and it is meaningless to re-transmit the instruction. Thus, the reply wait time may be set to be longer than the standby time and less than the feedback timeout threshold.

In a conventional display panel, the configuration instruction for the source driver may be transmitted only through the second signal line. As stated above, there is some configuration information that needs to be transmitted when the second signal line is not ready at the power-on initialization phase. Since the transmission of these configuration information is dependent on the second signal line in the conventional display panel, these configuration information cannot be transmitted before the second signal line is ready. However, the embodiments of the present disclosure use the first signal line that is independent of the second signal line, define a particular signal instruction sequence as shown in FIG. 1B and adopts Manchester encoding, to realize the transmission of these configuration information before the second signal line is ready, which enriches the functions of the first signal line and enhances the utilization rate of the first signal line. In addition, the present disclosure enables the collaboration between the first and second signal lines, thereby realizing the separate control of the specific source driver or overall control of a plurality of source drivers with different operational modes and different configuration instructions. This requires no modification of the driver design, and therefore reduces unnecessary consumption.

It shall be explained that the sequence of the steps of the drive control methods provided by the embodiments of the present disclosure may be adjusted appropriately, and the steps may be added or removed according to the situation. Any varied method that may be readily envisaged by one skilled in the art within the technical scope disclosed by the present disclosure shall be within the scope of protection of the present disclosure, and will not be reiterated herein.

Figure 5A:
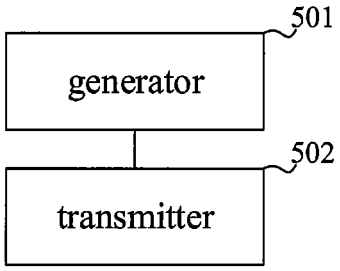
FIG. 5A is a structural schematic view of a drive control assembly provided by an embodiment of the present disclosure.

FIG. 5A shows a drive control assembly provided by an embodiment of the present disclosure. It is applied to the time sequence controller as shown in e.g. FIG. 1A. The time sequence controller is connected with a plurality of source drivers that are parallel-connected, through a first signal line. As shown in FIG. 5A, the drive control assembly may comprise a generator 501 used to generate a broadcast configuration instruction. The broadcast configuration instruction is used to instruct the plurality of source drivers to perform driver configuration according to the broadcast configuration instruction. As shown in FIG. 5A, the drive control assembly may further comprise a transmitter 502 used to transmit the broadcast configuration instruction through the first signal line.

The transmitter in the drive control assembly provided by an embodiment of the present disclosure can transmit the broadcast configuration instruction through the first signal line so as to realize the control of various source drivers by the time sequence controller, thereby enriching the functions of the first signal line and enhancing the utilization rate of the first signal line.

In an embodiment, each instruction transmitted in the first signal line may comprise a preamble code, a start identifier, data bits and an end identifier that are sequentially arranged.

The preamble code is used to instruct a receiving terminal to perform clock and phase calibration, the start identifier is used to indicate the start of data transmission, the data bits are used to carry configuration data, and the end identifier is used to indicate the end of data transmission.

In an embodiment, the preamble code is obtained from consecutive binary 0s in at least 8 bits by Manchester encoding. The start identifier comprises consecutive binary 0s in at least 2 bits. The configuration data carried by the data bits is the data obtained by Manchester encoding. The end identifier comprises consecutive binary 1s in at least 2 bits.

In an embodiment, the time sequence controller is connected with the plurality of source drivers respectively through a plurality of second signal lines. The broadcast configuration instruction comprises the number, transmission rate and signal equalizer information of the second signal line connected with each source driver.

In an embodiment, the generator 501 is also used to generate a point-to-point configuration instruction. The point-to-point configuration instruction comprises the ID of a specific source driver (e.g., a first source driver), and the specific source driver is any one of the plurality of drivers.

The transmitter 502 is also used to transmit the point-to-point configuration instruction through the first signal line.

Figure 5B:
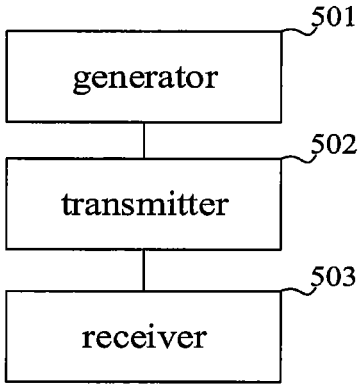
FIG. 5B is a structural schematic view of another drive control assembly provided by an embodiment of the present disclosure.

In this case, as shown in FIG. 5B, in addition to various components as shown in FIG. 5A, the drive control assembly may further comprise: a receiver 503 used to receive, through the first signal line, a configuration response instruction transmitted by the source driver. The configuration response instruction is transmitted to the time sequence controller by the source driver according to the point-to-point configuration instruction after the source driver detects the ID in the point-to-point configuration instruction as its own ID.

Figure 5C:
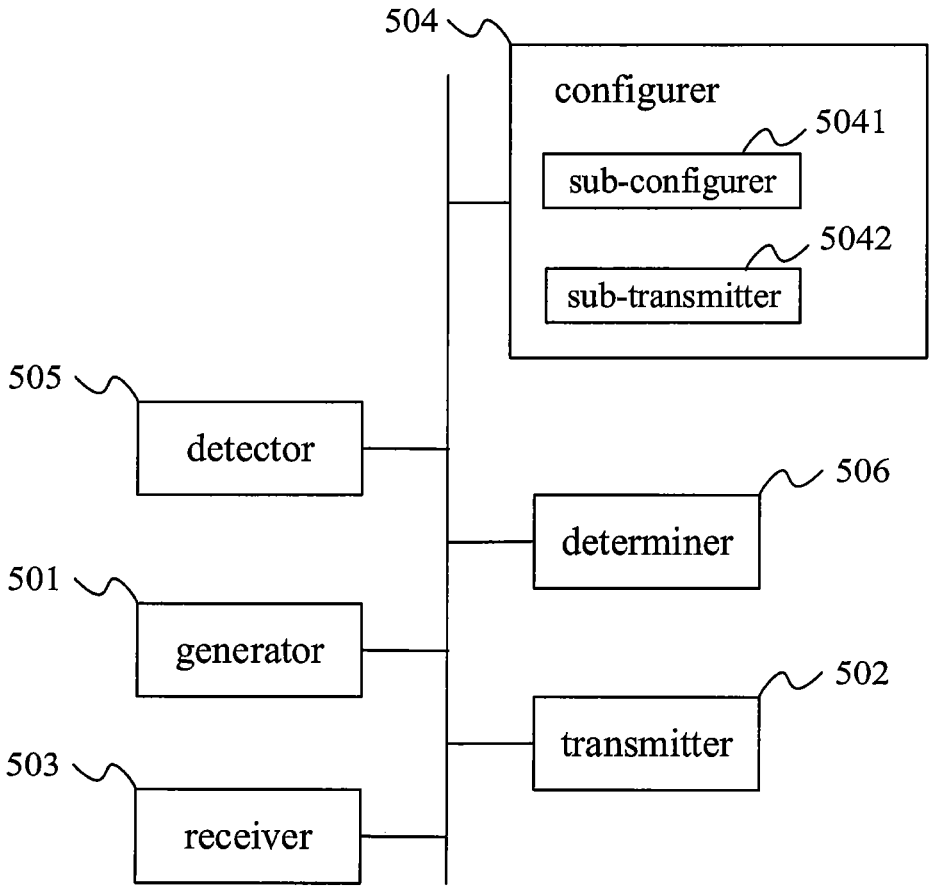
FIG. 5C is a structural schematic view of a further drive control assembly provided by an embodiment of the present disclosure.

In an embodiment, as shown in FIG. 5C, in addition to various components as shown in FIG. 5B, the drive control assembly may further comprise: a configurer 504 used to configure an ID for the specific source driver based on a target second signal line connecting the time sequence controller and the specific source driver, and the first signal line.

In an embodiment, the configurer 504 may comprise a sub-configurer 5041 used to set a signal in the target second signal line as an unconventional signal and signals in the plurality of second signal lines, except the target second signal line, as a conventional signal. The unconventional signal is different from the conventional signal, and the conventional signal is the signal transmitted during the normal operation of the second signal line. In another embodiment, the sub-configurer 5041 may also be used to set a signal in the target second signal line as a conventional signal and signals in the plurality of second signal lines, except the target second signal line, as an unconventional signal. Those skilled in the art can readily conceive of a method for distinguishing the specific second signal line from other second signal line.

In an embodiment, the configurer 504 may further comprise a sub-transmitter 5042 used to transmit the identity configuration instruction to the source driver through the first signal line. The identity configuration instruction comprises the ID of the specific source driver.

In this case, the receiver 503 may also be used to receive the identity configuration response instruction transmitted by the specific source driver. The identity configuration response instruction may comprise the ID of the specific source driver.

Correspondingly, as shown in FIG. 5C, the drive control assembly may further comprise a detector 505 used to detect whether the ID in the identity configuration response instruction is the same as the ID in the identity configuration instruction. The drive control assembly may further comprise a determiner 506 used to determine the ID of the specific source driver is successfully configured when the ID in the identity configuration response instruction is the same as the ID in the identity configuration instruction.

In an embodiment, the standby time may be preset at intervals between two adjacent instructions transmitted by the time sequence controller.

In an embodiment, the second signal line is a differential signal line, and the differential signal line comprises two sub-signal lines. In this case, the sub-configurer 5041 may also be used to set the signals in the two sub-signal lines in the target second signal line at the same level, and the signals in the two sub-signal lines included in each of the plurality of second signal lines, except the target second signal line, at different levels. Thus, it may prompt that an ID is being configured for the source driver connected with the target second signal line.

The transmitter in the drive control assemblies provided by the embodiments of the present disclosure can transmit the broadcast configuration instruction or the point-to-point configuration instruction through the first signal line so as to realize the control of various source drivers by the time sequence controller, thereby enriching the functions of the first signal line and enhancing the utilization rate of the first signal line.

Figure 6A:
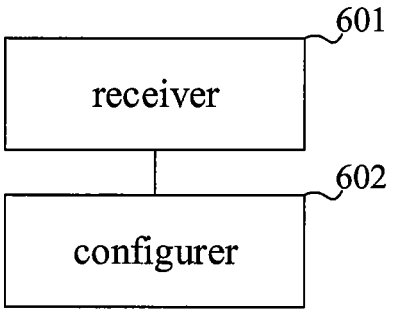
FIG. 6A is a structural schematic view of a drive control assembly provided by another embodiment of the present disclosure.

FIG. 6A shows a drive control assembly provided by another embodiment of the present disclosure. It is applied to any one of the source drivers as shown in e.g. FIG. 1A. As shown in FIG. 6A, the drive control assembly may comprise a receiver 601 used to receive a broadcast configuration instruction transmitted by the time sequence controller through the first signal line. As shown in FIG. 6A, the drive control assembly may further comprise a configurer 602 used to perform driver configuration according to the broadcast configuration instruction.

The receiver in the drive control assembly provided by an embodiment of the present disclosure can receive the broadcast configuration instruction transmitted by the time sequence controller through the first signal line so as to realize the control of the source driver by the time sequence controller, thereby enriching the functions of the first signal line and enhancing the utilization rate of the first signal line.

In an embodiment, each instruction transmitted in the first signal line may comprise a preamble code, a start identifier, data bits and an end identifier that are sequentially arranged. The preamble code is used to instruct a receiving terminal to perform clock and phase calibration, the start identifier is used to indicate the start of data transmission, the data bits are used to carry configuration data, and the end identifier is used to indicate the end of data transmission.

In an embodiment, the preamble code is obtained from consecutive binary 0s in at least 8 bits by Manchester encoding. The start identifier comprises consecutive binary 0s in at least 2 bits. The configuration data carried by the data bits is the data obtained by Manchester encoding. The end identifier comprises consecutive binary 1s in at least 2 bits.

In an embodiment, the time sequence controller is connected with the plurality of source drivers respectively through a plurality of second signal lines. The broadcast configuration instruction may comprise the number, transmission rate and signal equalizer information of the second signal line connected with each source driver.

In an embodiment, the receiver 601 is also used to receive a point-to-point configuration instruction transmitted by the time sequence controller through the first signal line, the point-to-point configuration instruction comprising an ID.

Figure 6B:
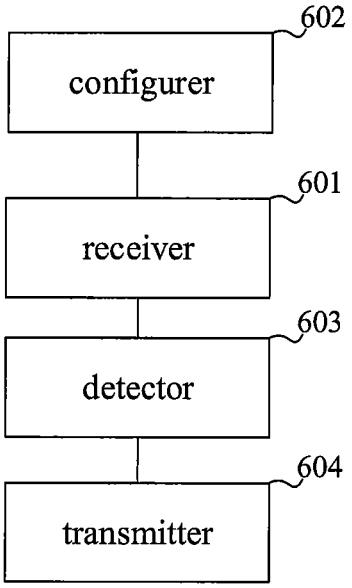
FIG. 6B is a structural schematic view of another drive control assembly provided by another embodiment of the present disclosure.

Correspondingly, as shown in FIG. 6B, in addition to various components as shown in FIG. 6A, the drive control assembly may further comprise: a detector 603 used to detect whether the ID in the point-to-point configuration instruction is the ID of the source driver used by itself. The drive control assembly may further comprise a transmitter 604 used to transmit a configuration response instruction to the time sequence controller through the first signal line according to the point-to-point configuration instruction after the ID in the point-to-point configuration instruction is determined as the ID of the source driver used by itself.

The configurer 602 may be used to configure the source driver used by itself according to the point-to-point configuration instruction after the ID in the point-to-point configuration instruction is determined as the ID of the source driver used by itself.

Figure 6C:
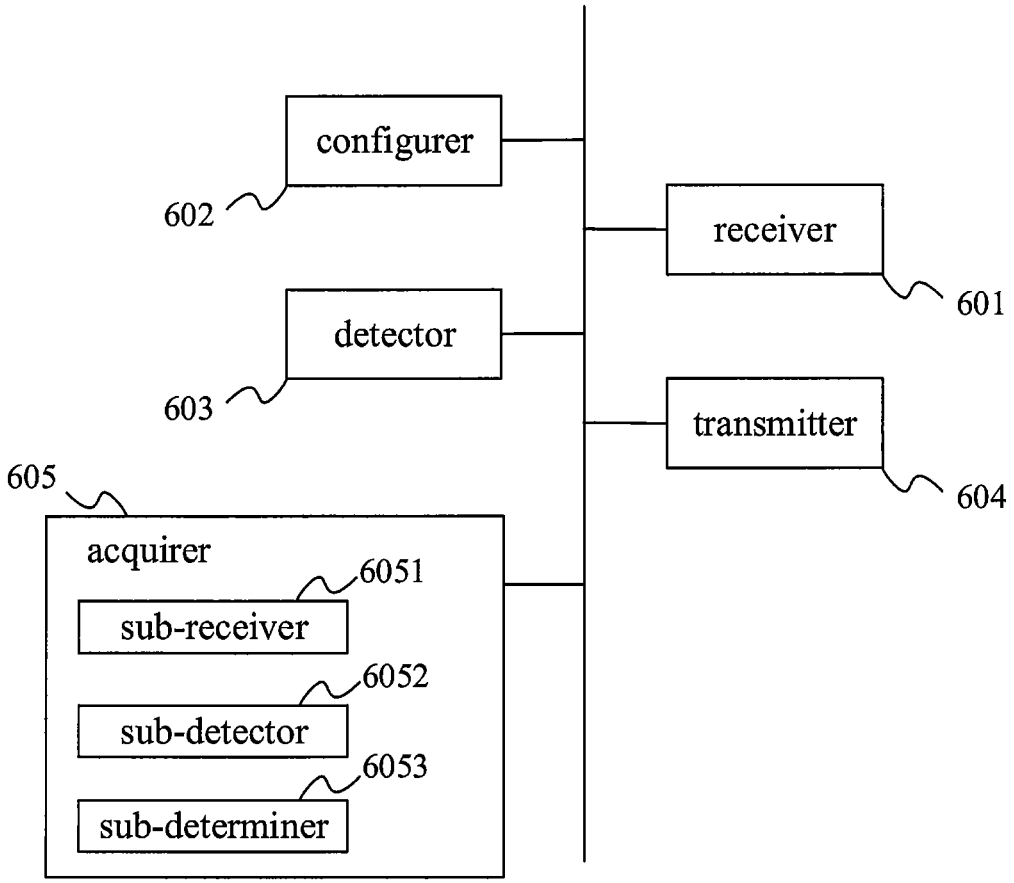
FIG. 6C is a structural schematic view of a further drive control assembly provided by another embodiment of the present disclosure.

In an embodiment, as shown in FIG. 6C, in addition to various components as shown in FIG. 6B, the drive control assembly may further comprise an acquirer 605 used to acquire the ID of the source driver used by itself, which is configured by the time sequence controller based on the target second signal line and the first signal line. The target second signal line is a second signal line connecting the time sequence controller and the source driver used by itself.

In an embodiment, as shown in FIG. 6C, the acquirer 605 may comprise a sub-receiver 6051 used to receive the identity configuration instruction transmitted by the time sequence controller through the first signal line, the identity configuration instruction comprising an ID. As shown in FIG. 6C, the acquirer 605 may also comprise a sub-detector 6052 used to detect the type of the signal in the target second signal line. The signal type is an unconventional signal or a conventional signal. As shown in FIG. 6C, the acquirer 605 may further comprise a sub-determiner 6053 used to determine the ID in the identity configuration instruction as the ID of the source driver used by itself when the signal in the target second signal line is an unconventional signal, and used to ignore the identity configuration instruction when the signal in the target second signal line is a conventional signal. According to the present disclosure, the unconventional signal is different from the conventional signal, and the conventional signal is the signal transmitted during the normal operation of the second signal line. In another embodiment, the sub-determiner 6053 may be used to determine the ID in the identity configuration instruction as the ID of the source driver used by itself when the signal in the target second signal line is a conventional signal, and used to ignore the identity configuration instruction when the signal in the target second signal line is an unconventional signal.

In an embodiment, the transmitter 604 may also be used to transmit the identity configuration response instruction to the time sequence controller. The identity configuration response instruction may comprise the ID of the source driver.

In an embodiment, the transmitter 604 may also be used to transmit the configuration response instruction to the time sequence controller through the first signal line according to the point-to-point configuration instruction after a preset reply wait time since the reception of the point-to-point configuration instruction.

In an embodiment, the reply wait time may be set to be longer than a standby time and less than a feedback timeout threshold. The standby time is the interval between two adjacent instructions transmitted by the time sequence controller.

In an embodiment, the second signal line is a differential signal line comprising two sub-signal lines. In this case, the sub-detector 6052 may be used to detect the signals in the two sub-signal lines of the target second signal line. When the signals in the two sub-signal lines are at the same level, the sub-detector 6052 may determine the signal in the target second signal line as an unconventional signal. When the signals in the two sub-signal lines are at different levels, the sub-detector 6052 may determine the signal in the target second signal line as a conventional signal.

The receiver in the drive control assembly provided by an embodiment of the present disclosure can receive the point-to-point configuration instruction transmitted by the time sequence controller through the first signal line so as to realize the point-to-point control of the first source driver by the time sequence controller, thereby enriching the functions of the first signal line and enhancing the utilization rate of the first signal line.

The embodiment of the present disclosure also provides a display device comprising a time sequence controller and source drivers. The time sequence controller is for example the time sequence controller 01 as shown in FIG. 1A, and the source driver is for example the source driver 02 as shown in FIG. 1A. The time sequence controller may comprise the drive control assembly as shown in any one of FIGS. 5A-5C. The source driver may comprise the drive control assembly as shown in any one of FIGS. 6A-6C.

The display device may be any product or component having a display function, such as an LCD panel, electronic paper, an organic light-emitting diode (OLED) panel, a mobile phone, a tablet computer, a TV, a display, a laptop computer, a digital photo frame, or a navigator.

Those skilled in the art can clearly understand that for the sake of easy and concise description, reference may be made to the corresponding process in the previous method embodiments for the specific operational process of devices, assemblies and appliances as stated above, which will not be reiterated herein.

Having considered the description and implementing the disclosure as disclosed herein, those skilled in the art will easily envisage other implementations of the present application. The present application intends to cover any variation, use or adaptive modification of the present application, which follows the general principles of the present application and includes common knowledge or conventional technical means in the technical field that is not disclosed in the present application. The description and embodiments are merely considered to be exemplary, and the true scope and spirit of the present application are indicated by the claims.

It shall be understood that the present disclosure is not limited to the precise structures as described above and shown in the drawings, and may be modified and changed without departing from the scope. The scope of the present disclosure is limited only by the appended claims.

What is claimed is:

1. A drive control method applicable to a time sequence controller, wherein the time sequence controller is connected with a plurality of source drivers that are parallel-connected, through a first signal line for bidirectional transmission of signals, the method comprising:

generating, by the time sequence controller, a broadcast configuration instruction for instructing the plurality of source drivers to perform driver configuration according to the broadcast configuration instruction;

transmitting, by the time sequence controller, the broadcast configuration instruction through the first signal line;

generating, by the time sequence controller, a point-to-point configuration instruction comprising an identification of a first source driver, the first source driver being one of the plurality of source drivers;

transmitting, by the time sequence controller, the point-to-point configuration instruction through the first signal line; and receiving, by the time sequence controller, through the first signal line, a configuration response instruction transmitted by the first source driver, wherein the configuration response instruction is transmitted to the time sequence controller by the first source driver according to the point-to-point configuration instruction, after the first source driver detects the identification of the first source driver in the point-to-point configuration instruction.

2. The method according to claim 1, wherein the time sequence controller is connected with the plurality of source drivers through respective ones of a plurality of second signal lines, and wherein the broadcast configuration instruction comprises a number, transmission rate and signal equalizer information of a respective second signal line of the plurality of second signal lines connected with each source driver of the plurality of source drivers.

3. The method according to claim 1, wherein before generating the point-to-point configuration instruction, the method further comprises:

configuring the identification of the first source driver based on a target second signal line and the first signal line, wherein the target second signal line is a second signal line connecting the time sequence controller and the first source driver.

4. The method according to claim 1, wherein each broadcast configuration instruction transmitted in the first signal line comprises a preamble code, a start identifier, data bits and an end identifier that are sequentially arranged;

wherein the preamble code is used to instruct a receiving terminal to perform clock and phase calibration, the start identifier is used to indicate the start of data transmission, the data bits are used to carry configuration data, and the end identifier is used to indicate the end of data transmission.

5. The method according to claim 4, wherein the preamble code is obtained from consecutive binary 0s in at least 8 bits by Manchester encoding;

the start identifier comprises consecutive binary 0s in at least 2 bits;

the configuration data carried by the data bits is the data obtained by Manchester encoding; and the end identifier comprises consecutive binary 1s in at least 2 bits.

6. A drive control method applicable to a first source driver, wherein the first source driver is one of a plurality of source drivers, and wherein the plurality of source drivers are connected in parallel and connected with a time sequence controller through a first signal line for bidirectional transmission of signals, the method comprising:

receiving, by the first source driver, a broadcast configuration instruction transmitted by the time sequence controller through the first signal line;

performing, by the first source driver, driver configuration according to the broadcast configuration instruction;

receiving, by the first source driver, a point-to-point configuration instruction transmitted by the time sequence controller through the first signal line, the point-to-point configuration instruction comprising an identification;

detecting, by the first source driver, whether the identification in the point-to-point configuration instruction identifies the first source driver; and transmitting, by the first source driver, a configuration response instruction to the time sequence controller through the first signal line according to the point-to-point configuration instruction after the identification in the point-to-point configuration instruction is determined as identifying the first source driver.

7. The method according to claim 6, wherein the time sequence controller is connected with the plurality of source drivers through respective ones of a plurality of second signal lines, and wherein the broadcast configuration instruction comprises a number, transmission rate and signal equalizer information of a respective second signal line of the plurality of second signal lines connected with each source driver of the plurality of source drivers.

8. The method according to claim 6, wherein before receiving the point-to-point configuration instruction transmitted by the time sequence controller through the first signal line, the method further comprises:

based on a target second signal line and the first signal line, acquiring the identification that is configured for the first source driver by the time sequence controller, the target second signal line being a second signal line connecting the time sequence controller and the first source driver.

9. The method according to claim 6, wherein each broadcast configuration instruction transmitted in the first signal line comprises a preamble code, a start identifier, data bits and an end identifier that are sequentially arranged;

wherein the preamble code is used to instruct a receiving terminal to perform clock and phase calibration, the start identifier is used to indicate the start of data transmission, the data bits are used to carry configuration data, and the end identifier is used to indicate the end of data transmission.

10. The method according to claim 9, wherein the preamble code is obtained from consecutive binary 0s in at least 8 bits by Manchester encoding;

the start identifier comprises consecutive binary 0s in at least 2 bits;

the configuration data carried by the data bits is the data obtained by Manchester encoding; and the end identifier comprises consecutive binary 1s in at least 2 bits.

* * * * *